United States Patent [19]

Hammond

[11] 4,154,164

[45] May 15, 1979

[54] WOODEN TRUSS FABRICATING JIG

[76] Inventor: Daniel B. Hammond, P.O. Box 7462, Colorado Springs, Colo. 80933

[21] Appl. No.: 899,343

[22] Filed: Apr. 24, 1978

[51] Int. Cl.[2] ..... B30B 3/00

[52] U.S. Cl. ..... 100/153; 100/154; 100/173; 100/176; 100/DIG. 13; 227/152; 269/321 F

[58] Field of Search ..... 100/153, 154, 138, 139, 100/156, 160, 161, 172, 173, 176, DIG.13, 210; 29/432, 432.2; 269/321 F; 144/288 C; 227/152

[56] References Cited

U.S. PATENT DOCUMENTS

| | | | |
|---|---|---|---|
| 3,538,843 | 11/1970 | Lubin | 269/321 F |
| 3,667,379 | 6/1972 | Templin | 269/321 F |
| 3,855,917 | 12/1974 | Farrell et al. | 100/DIG. 13 |
| 3,868,898 | 3/1975 | Sanford | 100/DIG. 13 |
| 3,903,583 | 9/1975 | Adams | 227/152 |
| 3,908,259 | 9/1975 | Adams | 227/152 |

*Primary Examiner*—Peter Feldman
*Attorney, Agent, or Firm*—Richard D. Law

[57] ABSTRACT

An assembly jig for fabricating wooden trusses including a moving jig platform on which toothed metal gusset plates are placed; wood truss component members assembled with each joint of the wooden member placed over the plates, toothed metal gusset plates placed on the upper side of each joint, and a series of three sets of small diameter pressure rollers press the plates flush into the wooden members when the moving jig platform moves the truss through the pressure rollers. A slide plate between the first two sets of small diameter rollers prevents curling of the plate partially pressed into wood members passing therethrough, and the third set of rollers completes the embedding of the teeth in the truss.

7 Claims, 7 Drawing Figures

WOODEN TRUSS FABRICATING JIG

This invention relates to assembly jigs for forming pre-cut, and assembled wood members into structural trusses, particularly rectangular wood trusses. A primary object of the invention is to provide improved and a simplified truss manufacturing jig, arranged to camber the truss in the manufacturing procedure.

PRIOR ART

Wooden truss manufacturing jigs have become common tools in the construction business, particularly for roof trusses, and recently for floor trusses or joists. One common type of truss is made from 2×4 lumber, and in some cases may be from 2×6 lumber. One well known type of assembly and manufacturing jig uses a movable platform on which the truss components are assembled, and the assembled truss, with toothed gusset plates on both sides of each joint, is passed through two sets of pressure rollers for embedding the plates into the wooden members. Examples of this type of unit are shown in U.S. Pat. No. 3,667,379 issued June 6, 1972, to Gail H. Templin, for Apparatus for Prefabricating Wood Structures and now assigned to assignee of the present application, U.S. Pat. No. 3,903,583 issued Sept. 9, 1975, to James D. Adams for Cambering Attachment for Truss Assembly Jig and U.S. Pat. No. 3,908,259 issued Sept. 30, 1975, to James D. Adams for Cambering Attachment for Truss Assembly Jig using Canted Roller Press. The first named patent shows a relatively large diameter pressure rollers for imbedding the teeth of the plates into the truss as the assembled components are progressively passed through the two sets of pressure rollers. This configuration is useful for various types of trusses, including generally triangular roof and partially flat roof trusses, and rectangular roof and floor trusses. Two such trusses may be manufactured at the same time and both simultaneously passed through the pressure rollers.

In pressing the toothed gusset plates into the wooden members, it was found that for two sets of rollers, the large diameter rollers (some 20" to 30" in diameter) were necessary to provide sufficent contact area on the plates being pressed into the wood, to completely press the teeth into the wood and prevent the plates from curling on passing through the superposed pressure rollers. These large diameter rollers do prevent the curling and do provide adequate pressure on the plates to press the teeth into the wood with the planar portion of the plate.

The two Adams patents are directed to devices similar to the Templin device, being directed mainly to the manufacture of rectangular trusses of a high ratio of length to depth, such trusses being used for flat roof trusses and floor trusses. These long span trusses require a camber or arching of the truss, to accomodate bending of the truss on installation in a structure, and two different types of cambering means are described. Both patents describe manufacturing units using the large diameter pressure rollers. All three units have a moving bed for passing trusses through the pressure rollers.

OBJECTS OF THE INVENTION

It is among the objects and advantages of the invention to provide a moving platform assembly jig using 3 small diameter pressure roller stations for pressing toothed gusset plates into assembled wooden components of trusses, particularly rectangular trusses with high length to depth ratio.

Another object of the invention is to provide a moving platform assembly jig, for manufacturing a single truss which is relatively inexpensive and is effective in the manufacturing procedure.

Still another object of the invention is to provide a moving platform truss assembly jig using small diameter pressure rollers in three stations, to completely embed the teeth of toothed gusset plates into the wooden members.

Yet another object of the invention is to provide a moving platform truss assembly jig using small diameter pressure rollers at each of three stations, and having means to prevent gusset plate curling on the passage of the plates between the superposed pressure rollers.

GENERAL DESCRIPTION OF THE DRAWINGS

These and other objects of the invention may be readily ascertained by reference to the following description and appended illustrations in which.

DETAILED DESCRIPTION OF THE DRAWINGS

Figure 1:
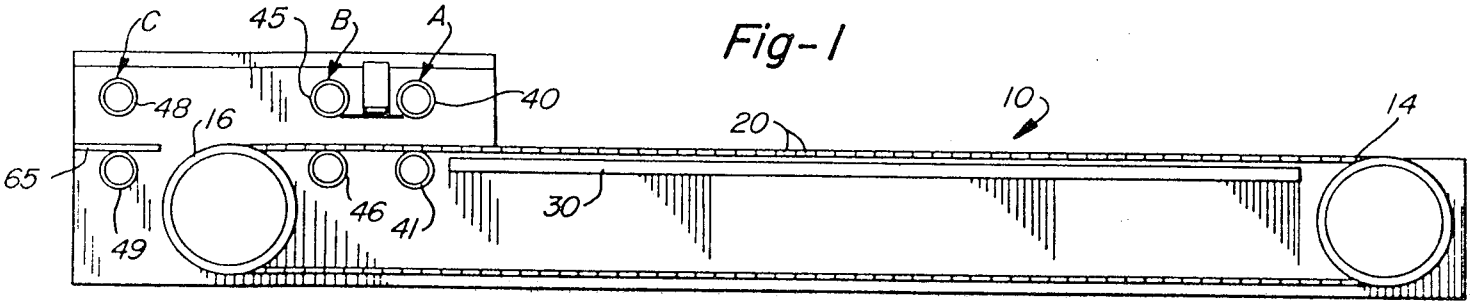
FIG. 1 is a generally schematic view of the major components of the moving platform assembly jig, with some parts in section.
Figure 4:
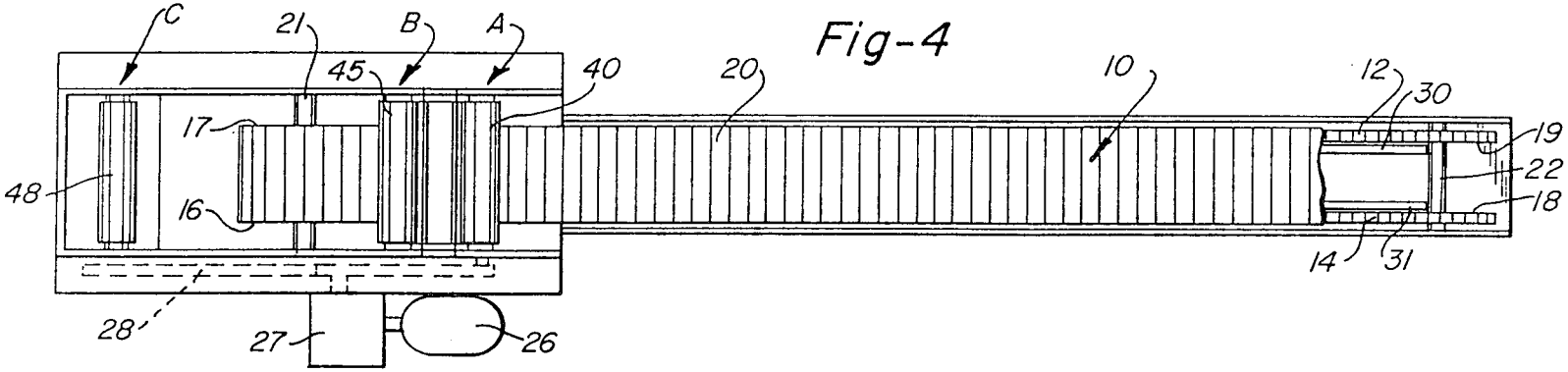
FIG. 4 is a schematic, top plan view of the truss assembly device of the invention, on a reduced size to show the complete unit.
Figure 5:
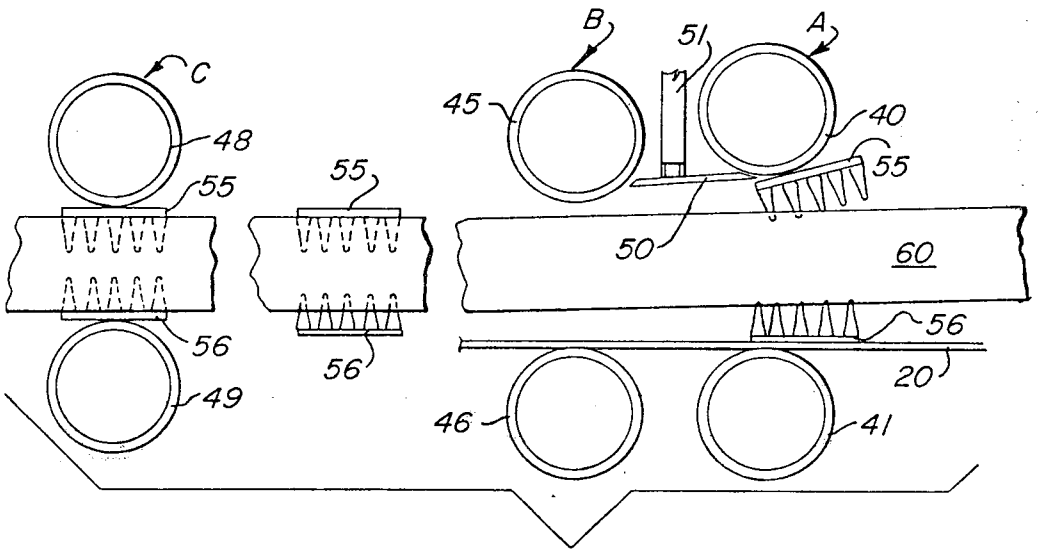
FIG. 5 is a schematic detailed, side elevational view of a portion of the pressure roller stations of the invention and their actions on a truss and gusset plates.
Figure 6:
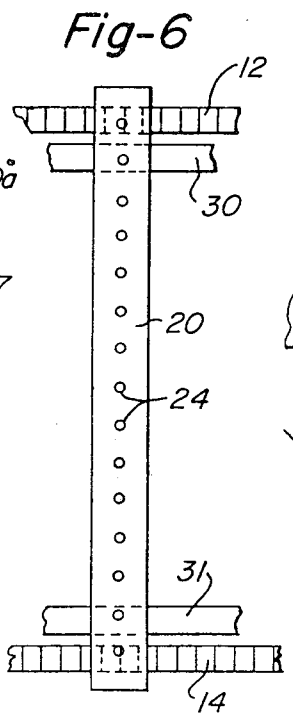
FIG. 6 is an elevational view of the moving assembly table and the first pressure roller station.
Figure 7:
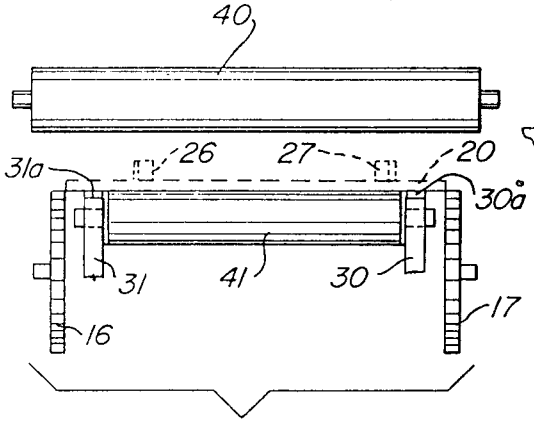
FIG. 7 is a detailed plan view of a slat of the moving assembly platform of the unit.

The major elements of the device of the invention are schematically shown in FIGS. 1 and 4. The moving platform of the truss assembly jig includes an endless conveyor, shown in general by numeral 10, which includes spaced apart chains 12 and 14. The chains pass over head sprockets 16 and 17 and tail sprockets 18 and 19. The sprockets are mounted on shafts 21 and 22 respectively so as to rotate conjointly and move the chains conjointly. On one stretch of the conveyor (between the end sprockets) is mounted a series of metal slats 20, shown in detail in FIG. 6, secured between the chains. The slats are sufficiently narrow so to pass around the sprockets at each end of the conveyor. Under normal circumstances only one stretch of the conveyor needs the slats to form a bed for assembling truss components. The slats are arranged adjacent to one another to form the bed. For a single truss assembling bed, the slats may be from about 24" to about 48". Each slat includes a plurality of threaded bolt holes 24 which are spaced across the lateral extent of a slat. These provide means for attaching the slat to the chains, and provide a base for mounting lumber stops by means of bolts. A pair of lumber stops are illustrated in FIG. 7 (in phantom) lines 26 and 27 indicating that they may be attached to the slats for holding the lumber components in their proper assembled condition. The plurality of bolt holes 24 provide means for placing the lumber stops to the position necessary for the particular design and size of the truss.

The sprockets are driven by means of an electric motor 26, through a speed reducer 27, which drives a chain drive 28 reeved over sprockets mounted on the shaft 21 and the shafts of the pressure roller stations, described in detail below. The slats are supported by means of longitudinal beams 30 and 31, which extend along a substantial portion of the top stretch of the chains. By placing a non-stick plastic strip along the top of the beams, the bed of slats 20 will easily slide along the beams, but be securely supported in aligned and generally horizontal positon. The plastic strips are illustrated in FIG. 7 as 30*a* mounted on the beam, 30 and 31*a* being mounted on the beam 31.

The pressure rollers are mounted in three (3) stations including a first station identified as Station A, a second station identified as Station B, and a third station identified as Station C. As shown in FIG. 1, Station A is mounted with an upper roller 40 above the top surface of the slats 20. A lower pressure roller 41 is mounted below the slats and the bed rides over the roller. The Station B includes an upper roller 45 mounted above the top surface of the slats 20, and a lower roller 46 mounted below the slats 20 in contact with the slats. The slats 20 ride on the rollers 41 and 46, providing support for the trusses on the bed passing through pressure roller stations. The pressure roller Station C includes an upper roller 48 and a lower roller 49, and this station is positioned beyond the endless conveyor. With the sprockets attached to the shafts of rollers 40 and 45, the chain 28 may be reeved over the sprockets to drive these rollers for rotation. In a similar manner, sprockets over the shafts of the roller 48 and 49 are reeved with the chain 28 so that the rolls 48 and 49 are driven. Thus, all the rolls are driven except the bottom roll 41 of Station A.

The rollers of the pressure stations are smooth surfaced rollers, and in one embodiment the rollers have a 4.460 inch diameter. This is between ¼ and 1/5 as large as the normally used 20" or larger rollers used for pressure rollers in the prior art assembly jigs, such as identified above. The drive sprockets mounted on the shafts of the rollers are of such size that the linear speed of the surface of the rollers is approximately the same linear speed as the moving table or platform. This permits a truss, passing through the pressure stations, to pass without being subjected to stresses induced by different linear speeds of the table and the surface of the rollers.

In stations A and B, the upper rollers 40 and 45 subject the gusset plates, positioned on the assembled truss passing through the stations, to a line contact, which is the actual narrow physical contact line between the plate and the roller. The bottom plates passing through the pressure stations, rest on the steel slats and are in a plane contact with the slats, since they are in face contact with the slats of the conveyor. The pressure on the toothed plates tends to bend or fold the teeth prior to penetrating the wood. The use of two pressure roller stations instead of one, is to prevent tooth folding due to the very sharp entrance angle induced when using small rolls versus large rolls. The plates have a tendency to fold up at their front upon entering the bight between the rolls, and there is a greater tendancy with the small rolls. Thus, the plates must be just started to penetrate the wood by the rolls of Station A, and the teeth are prevented from withdrawing or pulling back out from the wood by the retainer plate 50. This retainer or slide plate prevents the plate from curling up around the exit side of the first upper roll. The bottom surface of the plate 50 is smooth for low friction on contact with the metal gusset plates and should be as close as possible on a tangent line to a vertical through the axis of each of the rollers.

The second upper roll 45 is lower than the first upper roll and finishes embeddment of the top plate into the wood. In one embodiment, the second upper roll is 5/16 inch lower than the first upper roll. This provides for the front pressure station to do a small portion of the work, with the remainder being done in the second station.

Figure 3:
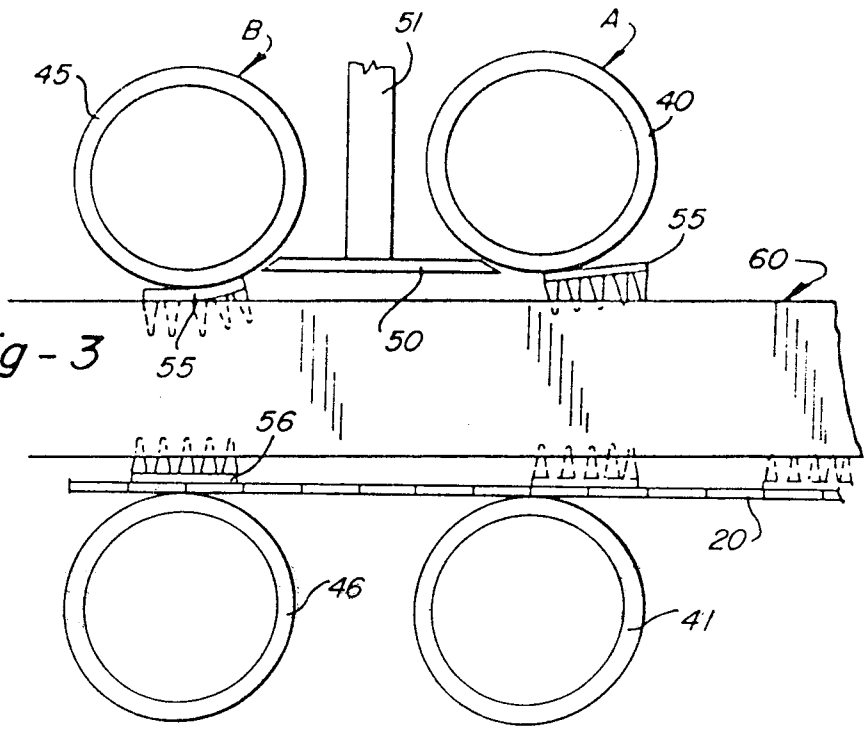
FIG. 3 is an enlarged detail side elevational view of the first two pressure roller stations of the assembly jig.
Figure 2:
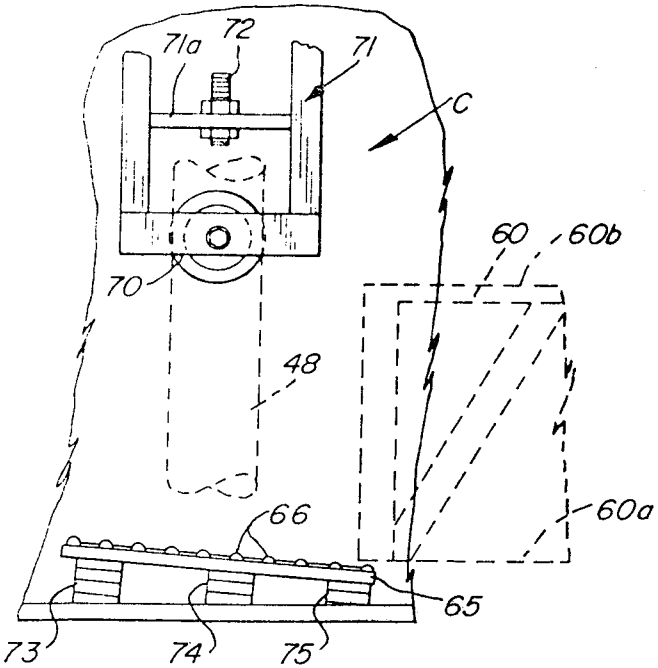
FIG. 2 is a partial top plan view of the cambering attachment of the assembly jig according to the invention.

The sequence of action of the first two stations is illustrated in FIG. 3. The assembled pre-cut components of a truss, shown in general by numeral 60, are mounted by means of lumber clamps (not shown) on the plurality of slats 20 forming the bed of the conveyor. The lumber clamps, their positioning and the assembly of the pre-cut components are known in the art, and generally are explained in the above three identified patents. In general, however, the toothed gusset plates for the lower side of each of the joints are placed on the movable table, and the wood members assembled over the plates, or the wood members are assembled on the table. The assembled truss is then raised and the plates are slid into position under the joints. When all of the bottom plates are positioned, toothed gusset plates are mounted on the top side of the truss over the joints. In some instances, a hammer blow on the plate will embed one or two teeth to hold the plate into position for the passage through the pressure rollers. With some types of toothed gusset plates, a nail or two may be used to secure the plate in position over the joint, however, such procedure is not necessary in every case. Once the truss is assembled with the plates, the motor 26 is started and the belt conveyor moves the truss toward the pressure roller stations.

As the truss and conveyor move through the pressure rolls, it is progressively acted on by Stations A, B and finally C. At Station A, the teeth of both the top and bottom plates are pressed into wood truss members to a depth of about 1/16 inch. Continual movement of the truss and conveyor moves the top plate under the retainer plate 50 preventing pull-out or curling. At Station B, the upper roll is about 5/16" closer to its bottom roll than at Station A, and the teeth of the top plate is pressed completely into the wood. At this point the plate is in tight face engagement with the wood and somewhat impressed into the surface of the wood. The teeth of the bottom plate are embedded about ½ of their length into the wood. At Station C, the teeth of the bottom plate are completely embedded in the wood, and the camber is simultaneously formed into the truss.

The configuration of the truss and the plates over the joints of the truss, causes the truss to be slightly angled up as the truss passes through Station A. This is due to the lower plate teeth being partially embedded in the wood by the pressure stations, which the truss before roll entry is on the tips of the teeth of the bottom plates.

As explained above, the long spans of rectangular trusses are preferably made with an arc of a camber. In the embodiment illustrated, the camber is forced into the assembly at the pressure Station C. For this purpose, a bar 65, angled to a straight line of a cord of the truss, having a plurality of rollers 66, is in position to contact the cord side 60*a* of a truss 60 passing therebetween. A lateral pressure roller 70 mounted under top roller 48 of the Station C is horizontally spaced from the plate 65. This roller is mounted in a framework, shown in general by numeral 71, and is journaled therein. A jackscrew 72 mounted in a lateral 71*a*, is mounted in the base frame of the unit and provides means for moving the roller 70 toward and away from the camber plate 65. The roller 70 pressing against the side of the truss forces it against the camber plate 65 and causes the truss to be cambered or arced as it passes through the pressure Station C. The amount of the camber is determined by shims 73, 74 and 75, which mount the camber plate 65 at an angle. In some instances, it may be desirable to use a readily adjustable camber plate, and this may be accomplished by using bolts with stops instead of the shims, or by using an adjustable frame somewhat similar to the frame 71. In most instances however, the camber will not vary greatly from truss to truss and frequent adjustment is not normally necessary.

The rollers of the pressure station are relatively small and are relatively inexpensive to manufacture, when compared with the larger 20" or greater diameter rollers used in conventional known devices. Rollers in the range of from about 4½" to about 10" in diameter are highly effective when used in conjunction with the slide plate to prevent the curling of the plates. The exact diameter of the rollers must be carefully considered in relation to the sprockets used for driving the rollers and the bed, so that the linear velocity of the surface of the rollers is the same or very nearly the same as the linear velocity of the surface of the moving table. The diameter of the rollers may be made very slightly oversize, for example, 0.004" to provide a very slight difference in lineal speed, but as the roller wears down, the speed differential of the lineal surface of the roller approaches 0 as compared to the lineal speed of the surface of the table. Continued wearing of the roller will move the difference between the lineal speed of the roller to that of the table to slightly opposite that originally made difference. The wearing of the rollers, however, is very slight, and the change should take place over a long period of time.

While the invention has been illustrated, by reference to a specific device, there is no intent to limit the sphere of the scope of the invention to the precise details so set forth except as to find in the following claims.

What is claimed is:

1. An assembly jig for fabricating wooden trusses having a moving platform on which components are assembled with toothed gusset plates on each side of the joints of the wooden members, and then the assembled truss is moved by the platform so as to be passed through means to embed the plates in the trusses, the improvement of:

a. a first and second pressure roll station spacedly arranged adjacent one end of the platform, each said roll station having a small diameter upper pressure roll juxtaposed above the top surface of the platform and each having a lower pressure means below the platform aligned with said upper pressure roll providing pressure back for the upper roll;

b. slide plate means mounted between said first and second upper pressure roll with its lower surface approximately on a tangent line between the lowermost surfaces of said roll, and closely adjacent the tangent line of a vertical line through the first upper roll's axis, arranged to prevent metal, toothed gusset plates on assembled trusses passing through the first pressure station from curling, and;

c. a third pressure roll station having a lower roll and a juxaposed upper roll, spaced from and adjacent said one end of the platform in position to receive a truss issued from said first and second pressure roll stations and complete the embedding of the toothed gusset plates into a truss.

2. An assembly jig according to claim 1, wherein said rolls of said pressure stations are from about 4½" to about 10 inches in diameter.

3. An assembly jig according to claim 1, wherein said first pressure roll station includes a roll under said platform, juxaposed in general vertical alignment with said upper roll.

4. An assembly jig according to claim 1, wherein camber forming means is mounted in said third pressure roll station.

5. An assembly jig according to claim 1, wherein said slide plate has smooth, low friction surface for contact with metal gusset plates.

6. An assembly jig according to claim 3, wherein said upper rolls are driven and the lower rolls of said second and third rolls are driven.

7. An assembly jig according to claim 1, 2, 3, 4 or 5, wherein said rolls are essentially the same diameter.

* * * * *